United States Patent [19]

Miyashita et al.

[11] Patent Number: 4,927,600

[45] Date of Patent: May 22, 1990

[54] METHOD FOR MOLDING OF POWDERS

[75] Inventors: Tsuneo Miyashita, Yokohama; Hiroaki Nishio, Yokohama; Kazuya Yabuta, Chiba; Yoshio Takagi, Yokohama, all of Japan

[73] Assignee: Nippon Kokan Kabushiki Kaisha, Tokyo, Japan

[21] Appl. No.: 105,985

[22] Filed: Oct. 8, 1987

Related U.S. Application Data

[63] Continuation of Ser. No. 866,359, May 23, 1986, abandoned.

[30] Foreign Application Priority Data

May 28, 1985 [JP] Japan ..... 60-113301

[51] Int. Cl.[4] ..... B22F 1/00

[52] U.S. Cl. ..... 419/49; 264/102; 264/313; 264/317; 264/517; 264/DIG. 78; 419/68

[58] Field of Search ..... 264/313, 317, DIG. 78, 264/102, 517; 419/68, 49

[56] References Cited

U.S. PATENT DOCUMENTS

| | | | |
|---|---|---|---|
| 2,129,240 | 9/1938 | Sanborn | 264/DIG. 78 |
| 2,513,785 | 7/1950 | Browne et al. | 264/517 |
| 4,582,682 | 4/1986 | Betz | 264/109 |
| 4,612,163 | 9/1986 | Nishio et al. | 419/68 |

FOREIGN PATENT DOCUMENTS 61-64801 4/1986 Japan .

*Primary Examiner*—James Derrington

*Attorney, Agent, or Firm*—Fleit, Jacobson, Cohn, Price, Holman & Stern

[57] ABSTRACT

The invention is concerned with the method of compression molding a metallic or ceramic powders. The method includes the step of maintaining a negative pressure within a first mold of noncompactable powders for intimately contacting on its inner surface a pouch-like member of thin-walled resilient material for producing a second mold, and the step of compactly charging starting powders into the second mold and exhausting air from and sealing the second mold, taking out a pre-molded body of the metallis or ceramic powders together with the second mold and the step of processing the pre-molded body by a cold or hot isostatic press.

4 Claims, 6 Drawing Sheets

METHOD FOR MOLDING OF POWDERS

This application is a continuation of application Ser. No. 866,359, filed May 23, 1986 now abandoned.

FIELD OF THE INVENTION

This invention relates to a method for molding of powders wherein powders such as metallic or ceramic powders are used for forming a molded body of improved dimensional accuracy.

BACKGROUND OF THE INVENTION

Description of the Prior Arts

The cold isostatic press method, hereafter abbreviated to CIP method, has been customarily used for pressure forming or molding. According to this method, metallic or ceramic powders are charged into a pouch of rubber-like resilient material which is then hermetically sealed and pressured from outside by a liquid such as water or oil as pressure medium to effect pressure forming or molding.

In this case, a rubber-like mold, hereafter abbreviated to rubber mold, usually formed of rubber, PVC or latex such as polyurethane, is used.

It goes without saying that the rubber mold should be of a strength and a thickness sufficient to prevent the mold from being deformed under the weight of charged powders.

In carrying out the aforementioned method, because of the different behavior in deformation between the rubber and the charged powders, it is a frequent occurrence that the hydrostatic pressure applied from outside the rubber mold is not directly transmitted to the charged powders and construction of the powders at the corner area is inhibited by the rubber material.

Therefore, the molded body not only tends to be deviated in shape from the rubber mold cavity under no-loaded conditions, but also tends to be cracked under the effect of the residual inner stress.

Hence, difficulties are presented in the conventional CIP method in obtaining an impeccable molded product having a high dimensional accuracy.

The inventors conducted eager researches into solving the aforementioned problem and arrived at an improved CIP method which constitutes the subject-matter of the Japanese Patent Application No. 59-183780 corresponding to U.S. Pat. No. 4,612,163.

In these applications, there is described a method for forming a mold while a tension is applied to the thin-walled rubber-like material. According to this method, since the rubber-like pouch is contracted with contraction of the charged powders, these powders are contracted uniformly, thus resulting in a molded body analogous in form to the initial charged material.

In more detail, to a gate member of an air permeable porous mold carrier is intimately secured the mouth of a thin-walled rubber-like pouch and the air outside of the air permeable mold carrier is exhausted for expanding the ru ber-like pouch into intimate contact with the inside of the mold carrier for forming the mold.

Then the starting powdered material is charged into the thus created mold space and the opening of the mold is sealed after the air is exhausted from the inside of the mold.

The atmosphere outside the air permeable mold cavity is reset to the atmospheric pressure to disintegrate the mold for taking out the pre-molded body which is processed with CIP for improving its density.

It is stated in the aforementioned applications that molded products of porous ceramics of polyamide resin, porous sintered alloy, porous ceramic-alloy composite material or plaster are preferred as air permeable mold carrier material.

However, these air permeable mold carriers tend to be costly since the molded products have to be produced with sufficient dimensional accuracy of the mold cavity and sufficient surface properties to permit shipping of the rubber-like resilient material.

In this manner, the method can be applied only to cases wherein a larger output can be expected from the molding operation.

SUMMARY OF THE INVENTION

It is an object of the present invention to make searches into improvement in the subject-matter of the afore-mentioned patent applications and, more specifically, to provide a method for molding powders of metals or ceramics comprising allowing a pouch-like member of thin-walled rubber-like resilient material to be expanded into tight contact with the inner surface of an air-permeable mold carrier of a powdered filler material maintained under a negative pressure for holding its form, thereby producing a mold; charging starting powders into said mold; discharging air from the inside of the mold through an opening of the pouch-like member; then sealing the mold; then disintegrating the air-permeable mold carrier for removing a pre-molded body or article enclosed in the pouch-like member; and processing the pre-molded body by a cold or hot isostatic press for increasing the density of said pre-molded body or article.

According to a preferred embodiment of the present invention, there is provided a method for molding powders comprising the steps of charging powders into a closed space having the form of a desired mold and constituted by a film and a filter, at least a wall of said closed space corresponding to a cavity being formed of a water-soluble film, and establishing a negative pressure within the closed space by air suction through the filter for maintaining the form of the powders for providing a mold carrier formed by said powders; the step of introducing into said cavity of said mold carrier a pouch of thin-walled rubber-like resilient material carrying the moisture on the outer surface thereof, dissolving said water-soluble film by contact of the rubber-like pouch, causing the force of suction to act on said rubber-like pouch for tensioning the pouch into tight contact with the cavity wall to produce a mold formed of the rubber-like pouch; the step of charging metallic or ceramic powders into the inside of the mold; the step of creating a negative pressure within the mold by air suction and hermetically sealing the mold; the step of discontinuing air suction through said mold cavity for re-establishing an atmospheric pressure therein and removing the powders constituting the mold carrier for producing a pre-molded body or article enclosed in a resilient material; the step of processing the enclosed pre-molded body by a cold hot isostatic press (CIP) or a hot isostatic press (HIP).

The film to be used under these conditions should be of the thermoplastic type while being of moderate thickness and having a tearing strength, moderate elongation and a sufficient tensile strength.

The films having these properties may include polyethylene films, polypropylene films, soft type PVC flexible films, modified PVA films, water-soluble films chlorinated rubber films, and polybutylene films. The film thickness may differ as a function of the mold shape or the film application, but may be selected so as to be within the range of 20 to 200 μm as the occasion may demand.

In addition to having the above described film properties, the water-soluble films to be applied to the cavity wall should be soluble in water within a shorter time in a range of the usual working temperature such as a range of 10° to 35° C.

The water-soluble film can be selected from the group consisting of PVA and methyl cellulose films with the film thickness ranging from 20 to 200 μm.

The filter is designed to prevent the mold-forming powders from being scattered into the suction system. Thus it is preferred that the filter be difficult to clog and low in pressure loss. For example, No. 200 to 250 mat weave wire mesh can be advantageously employed.

The pouch of thin-walled rubber-like resilient material is formed of natural rubber or synthetic rubber such as styrene-butadiene rubber, polyisoprene rubber or isobutyleneisoprene rubber. The film thickness varies for example with the size of the mold to which the pouch is applied, but it can be suitably selected so as to be within the range of ca. 50 to 1000 μm.

The particles of the powdered material that makes up the mold carrier can be broadly selected from the group consisting of sand, plastic flour, ceramic powders or metallic powders, on the condition that the particles should not be readily pulverized or deformed upon injection into the space having the form of the mold carrier.

the metallic or ceramic powders to be molded should be processed to have the particle size and shape that will assure improved fluidity of the processed powders.

More specifically, for stainless steel, tool steel or superalloy, spheridal powders manufactured by the argon gas atomizing method, vacuum spraying method or the rotating electrode method, are most preferred. For titanium and titanium alloys, spheroidal powders obtained by a plasma rotating electrode method are preferred.

Fine metallic powders such as carbonyl iron or carbonyl nickel, cemented carbide powders, alumina, zirconia, silicon nitride, silicon carbide or sialon (Si-Al-O-N) powders are usually fine profiled powders with particle size less than several microns while being also poor in fluidity, so that spheroidal powders processed into granular form are more preferred.

DESCRIPTION OF THE PREFERRED EMBODIMENT

The molding method according to the present invention will be hereafter explained by referring to the accompanying drawings.

Figure 1:
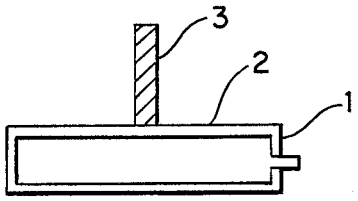
FIGS. 1 to 13 are diagrammatic views showing a typical molding method of the present invention in the sequence of the process steps.
Figure 2:
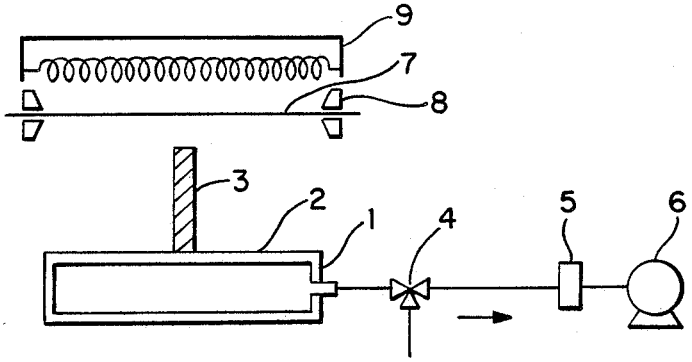
Figure 3:
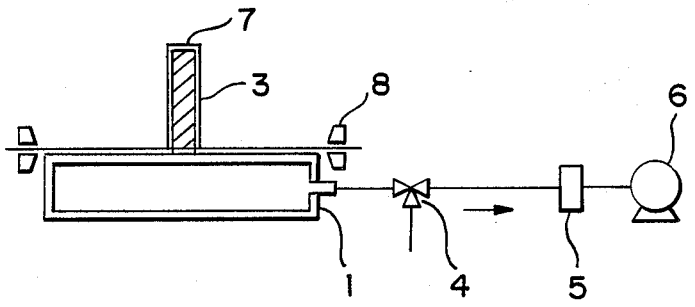
Figure 4:
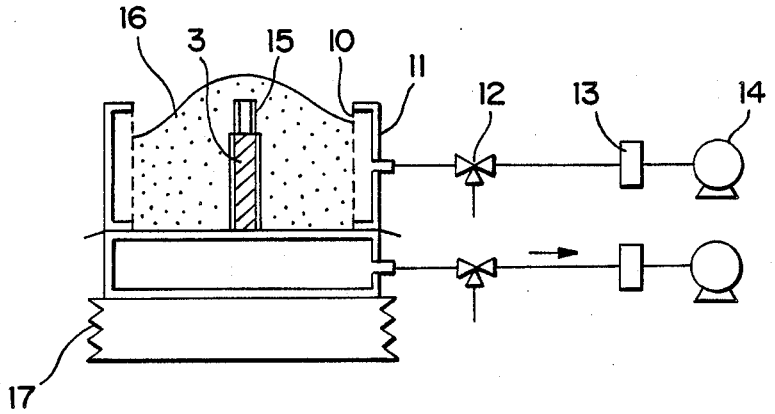

As shown in FIG. 1, a stationary base plate 2 having a vent hole is mounted on a suction box 1, and a pattern 3 is mounted in position on the base plate 2. A vacuum suction system including a three-way changeover valve 4, a dust filter 5 and a vacuum pump 6 is mounted on the suction box 1. A clamp frame 8 for clamping a water-soluble film 7 and an electric heater 9 are installed on top of the pattern 3.

Heating can be effected not only by an electric heater, but also by a gas or by a hot air type heater.

The water-soluble film 7 is heated by the heater, while a vacuum pump 6 is actuated.

Steam can be added to promote elongation of the water-soluble film 7.

After the film 7 reaches the optimum molding temperature, the clamp frame 8 is moved to the fixed base plate and the film 7 is intimately affixed to the base plate 2 and the pattern 3 by vacuum suction. The overall unit excluding the clamp frame 8 which is detached at this time is secured onto a vibration table 17.

On the base plate 2, a metallic frame 11 having a filter 10 is placed for encircling the pattern 3. A three-way cock 12, a filter 13 and a pump 14 that make up a vacuum suction system is connected to the frame 11, and a sleeve 15 sheathed by a film is placed on the pattern 3. Then, powders 16 for the molding of a mold support or carrier are injected.

Then, the vibration table 17 is set into operation for charging the powders 16 in compacted state into the mold 11 and any excess powders are removed so that the upper surface or level of the powders is flush with the upper edges of the metallic frame 11.

Figure 5:
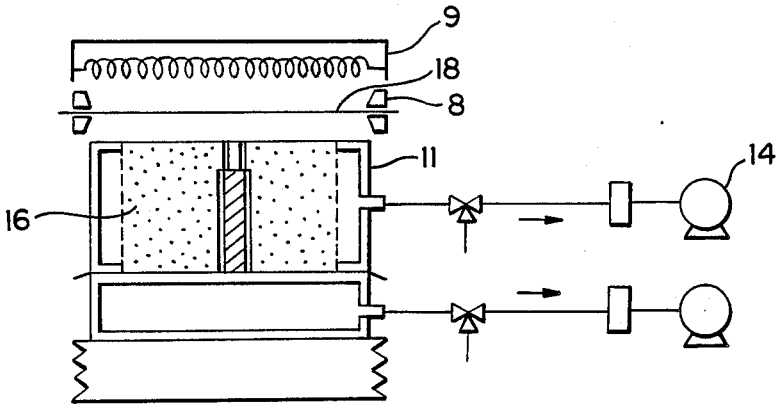

Then, as shown in FIG. 5, a clamp frame 7 clamping a film 18 and an electric heater 9 are placed on top of the metallic frame 11.

The vacuum pump 14 is actuated while heating the film 18.

Figure 6:
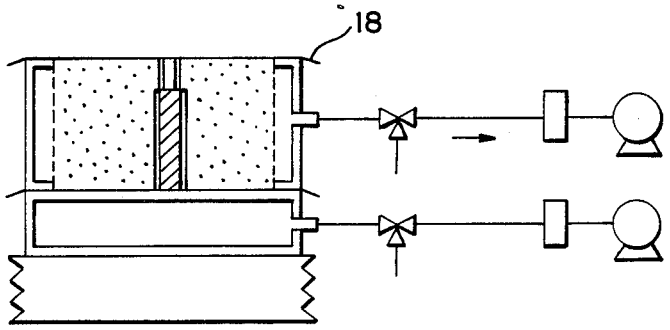

When the film 18 reaches the molding temperature, the clamp frame 8 is shifted to the metallic mold 11, and the film 18 is intimately contacted with the powders 16 by vacuum suction. Then, the clamp frame 8 is removed, the water-soluble film 7 and the film 18 encircling the metallic mold 11, as shown in FIG. 6.

Figure 7:
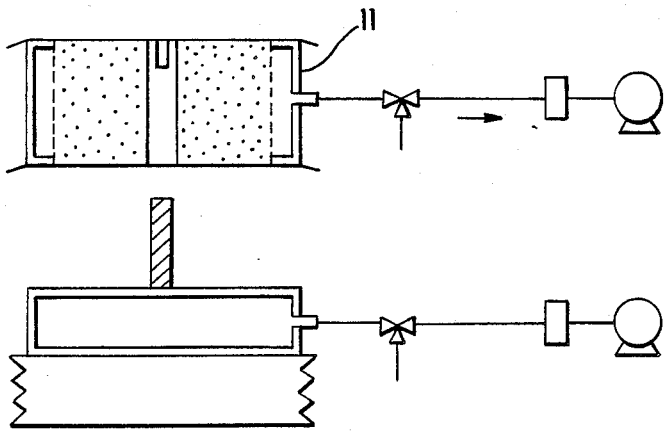

Then, as shown in FIG. 7, the metallic mold 11 is lifted, with the pattern 3 being left for removal.

Figure 8:
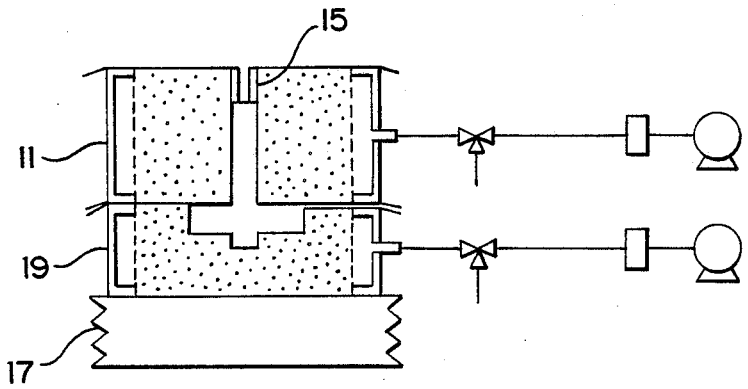

By the similar sequence of operations to that described above for the forming of the upper mold, a lower mold is prepared by making use of a metallic frame 19. Then, as shown in FIG. 8, the metalic molds 19, 11 are stacked one upon the other on the vibration table 17. A heated metallic rod is then introduced into the sleeve 15 from above for forming a bore and a mold cavity.

Figure 9:
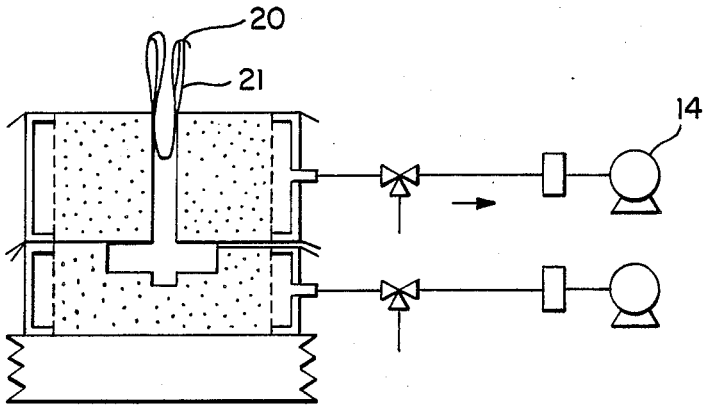

Then, as shown in FIG. 9, a gate member 21 to which is affixed a thin-walled pouch 20 of a rubber-like resilient material having water contents on the outer surface thereof is affixed to a sleeve 15, and the foremost part of the rubber pouch 20 is contacted with the water-soluble film that makes up the mold cavity.

In this manner, the water-soluble film at the contacting portion is melted so that the force of suction developed by the vacuum pump 14 will act directly on the rubber pouch 20. Thus the rubber pouch 20 is extended into renewed contact with the water-soluble film for dissolving it, the rubber pouch 20 being extended further.

In this manner, the rubber pouch 20 is intimately contacted with the cavity wall in its entirety for forming a thin-walled mold of the rubber-like material.

Figure 10:
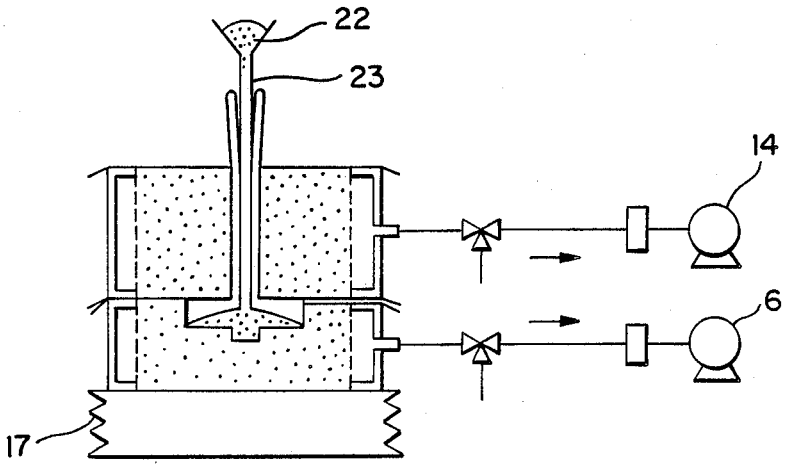
Figure 11:
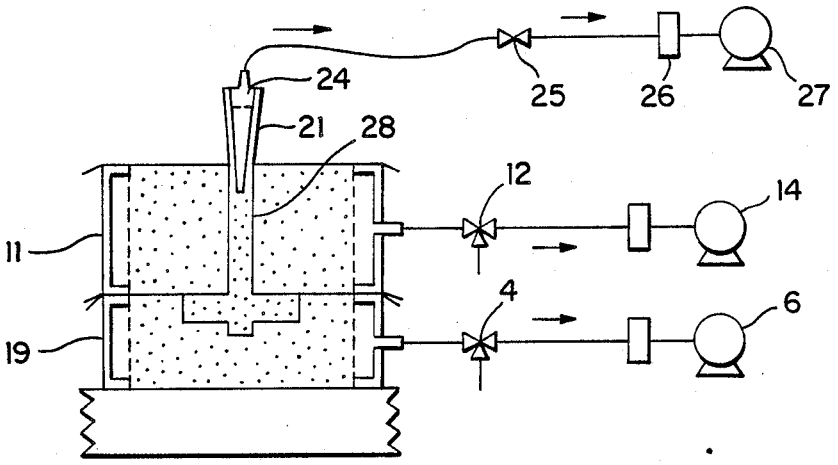

After the completion of the rubber mold, starting powders 22 are introduced from a supply device 23 into the mold, as shown in FIG. 10, while the vibration table 17 is in operation. During this time, the operation of the vacuum pumps 14, 16 is continued.

After the charging of the starting powders 22 is terminated, a dust filter 24 is placed in the gate member 21 and a vacuum pump 27 is driven into operation so that the internal pressure is reduced to a level not higher than about $1.33\times10^2$ Pa (100 Torr) and preferably not higher than about $1.33\times10$ Pa (10 Torr), by way of a valve 25 and a filter 26, for purging air from the gaps between adjacent particles of the starting powders.

During this operation, the pumps 14, 16 are in operation for preventing the inlet to the rubber mold 28 from collapsing by maintaining the external pressure applied to the rubber mold 28 to a value lower than the internal pressure.

As the internal pressure within the rubber mold 28 reaches a predetermined negative value, the operation of the vacuum pump 27 is commutated to a holding operation for holding this negative pressure value, while the vacuum pump 14 is halted and the three-way changeover valve 12 is commutated for re-establishing an atmospheric pressure outside of the upper rubber mold 28. Since the predetermined negative internal pressure prevails within the rubber mold 28, the rubber material at the inlet of the rubber mold 28 is collapsed to stop up the inlet. At this time, the gate member 21 is elevated and the collapsed rubber material at the inlet is held by the clamp 29 for sealing. The vacuum pump 27 is then halted and both the dust filter 24 and the gate member 12 are removed. During this time, operation of the vacuum pump 6 is continued without cessation.

Figure 12:
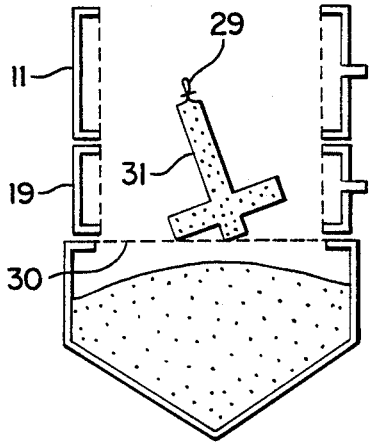
Figure 13:
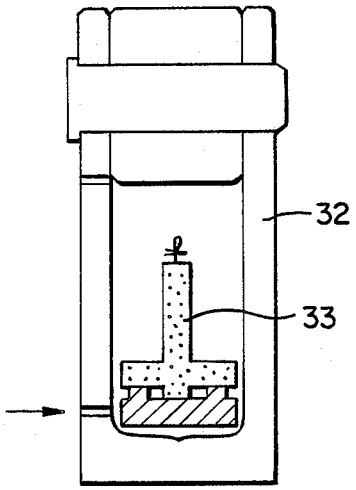

Then, the metalic frames 11, 19 stacked one upon the other are placed on a screen 30 as shown in FIG. 12. Then the operation of the vacuum pump 6 is terminated and the three-way valve 4 is commutated in such a manner that the atmospheric pressure is re-established in the region outside the lower rubber mold.

By this operation, the powders contained in the metal frames 11, 19 for the formation of the mold carrier are collapsed by their own weight to break through the film and the water-soluble films so as to descend through the screen 30, while a pre-molded body or article 31 is left on the screen 30.

Since the negative pressure prevails within the interior of the pre-molded body 31, the isostatic pressure equivalent to the differential pressure between it and the atmospheric pressure acts on the pre-molded body, so that the pre-molded body can sustain its form without exterior supporting.

Finally, the pre-molded body 31 is housed within a CIP unit 32 into which water is supplied under pressure to elevate the pressure in the unit to ca. 2026.5 to $4053\times10^5$ Pa (2000 to 4000 atom.) and maintained thereat for several minutes. In this manner, the pre-molded body 31 is contracted and increased in density to provide a molded body 33.

After terminaton of the operation, the pressure in the unit is lowered to an ambient pressure inorder to take out the molded body 33.

The thus-obtained molded body 33 can be easily taken out by dismounting the clamp 29 and peeling off the rubber mold 28.

The molded body 33 can be sintered or calcined when so desired.

In more detail, the molded body obtained by the aforementioned method by using WC-10% Co cemented carbide granules as starting powders can be subjected to defatting and vacuum calcination followed by processing in a hot isostatic press to give a calcined body of higher density. Alternatively, the molded body produced by the aforementioned method and by using $Si_3N_4$-8% $Y_2O_3$ granules as starting powders can be subjected to defatting followed by calcination at ambient pressure in a nitrogen atmosphere so as to give a sintered molded body or article.

Still alternatively, spheroidal powders of the IN-100 superally manufactured by the rotating electrode method can be used as starting materials in the aforementioned method and the resulting sintered body can be calcined in vacuum and processed in HZP so as to produce the sintered molded body or article of higher density.

The aforementioned method of the present invention makes it possible to use a mold carrier of less costly powders as air permeable mold carrier material and hence to dispense with the use of the expensive molded member as mold carrier.

The method also has an advantage that the molded body of improved dimensional accuracy can be prepared from metallic and ceramic powders at reduced costs.

EXAMPLE

Two samples of the molded body were prepared from C-1018 steel spheroidal powders with the particle size of the order of 80 to 200 meshes and alumina powders with particle size of 20 to 100 μm.

The pattern used was made up of a shaft 20 mm in diameter and 60 mm in length and a disk 80 mm in diameter and 15 mm in thickness and attached to the shaft at a distance of 20 mm from one end of the shaft. Dried silica sand with a grain size of 100 to 150 meshes was used as the powders for forming the mold. Polyvinyl alcohol (PVA) films 50 μm in thickness were used for both the film and the water-soluble film, while the rubber latex pouch about 200 μm in thickness, about 10 mm in the opening diameter and about 50 mm in length was used as the thin-walled pouch of rubber-like resilient material.

The outer surface of the rubber pouch was coated with an aqueous solution with a polyvinyl alcohol concentration of 10 percent for carrying the moisture. The pre-molded body was produced by employing the aforementioned method and subjected to a CIP processing at a pressure of $3040\times10^5$ Pa (3000 atom) for increasing its density through compaction for completing a molded disk.

True circularity of the disk was measured. It was found that there were substantially no fluctuations in the disk diameter with the rate of change being lesser than 1.2 percent. The measured disk diameters were as follows:

Spheroidal Steel Powders 72.90±0.13 mm
Alumina Granules 68.10±0.09 mm

What is claimed is:

1. A method of molding powders of metals or ceramics comprising the steps of:

forming a cavity within an air-permeable mold carrier of a powdered filler material, a wall of said cavity being coated with a water-soluble film, and maintaining the shape of said powdered filler material by use of a vacuum;

introducing into said cavity of said mold carrier a pouch-like member of thin-walled rubber-like resilient material, said pouch-like member carrying moisture on the outer surface thereof;

dissolving said water-soluble film by contacting said water-soluble film with said pouch-like member, during the use of said vacuum in such a degree that said pouch-like member is inflated and tightly contacted to said wall of said cavity in said mold carrier, thereby forming a mold;

charging starting powders into said mold;

discharging air from the inside of the mold to a desired degree of vacuum through an opening of said pouch-like member;

sealing said evacuated mold while the pouch-like member is within the cavity of said mold carrier;

re-establishing an atmospheric pressure to said powdered filler material thereby disintegrating the air-permeable mold carrier so as to remove a preformed molding in a form contained in said sealed pouch-like member; and pressing the preformed molding while the molding is sealed within the pouch-like member by a cold or hot isostatic press to densify the same.

2. A molding method according to claim 1, wherein said water-soluble film is selected from the group consisting of PVA and methyl cellulose films.

3. A molding method according to claim 1, wherein said water-soluble film has a thickness ranging from 20 to 200 μm.

4. A molding method according to claim 1, wherein said water-soluble film is soluble in water within a working temperature range of 10° to 35° C.

* * * * *